US005535761A

United States Patent [19]

Holifield

[11] Patent Number: 5,535,761

[45] Date of Patent: Jul. 16, 1996

[54] CIGARETTE HOLDER

[76] Inventor: John M. Holifield, 5704 Antoine Rd., Mobile, Ala. 36693

[21] Appl. No.: 510,608

[22] Filed: Aug. 3, 1995

[51] Int. Cl.[6] ..... A24D 1/12

[52] U.S. Cl. ..... 131/174; 131/175

[58] Field of Search ..... 131/174, 175, 131/231, 240.1, 187

[56] References Cited

U.S. PATENT DOCUMENTS

| | | | |
|---|---|---|---|
| 1,976,653 | 10/1934 | Brueck | 131/51 |
| 2,366,686 | 1/1945 | Hollaran | 131/175 |
| 2,617,429 | 11/1952 | Smereck | 131/257 |
| 2,729,215 | 1/1956 | Dahly | 131/175 |
| 2,910,074 | 10/1954 | Blackwell | 131/257 |
| 3,756,252 | 9/1973 | Vigorito | 131/256 |
| 4,061,149 | 12/1977 | Raczkowski | 131/175 |

*Primary Examiner*—Vincent Millin
*Assistant Examiner*—Charles W. Anderson
*Attorney, Agent, or Firm*—Joseph N. Breaux

[57] ABSTRACT

A cigarette holder removably connectable between a window and a door frame of a vehicle for directing cigarette smoke out of the vehicle is provided. The cigarette holder comprises: a first and second rigid planar member having an interior and exterior surface, the planar members being connected along a longitudinal edge forming an acute angle, a sidewall connected along a lateral edge of the first and second planar members forming a slot therethrough for snugly entrapping a cigarette, a first pair of tabs mounted along the exterior surface of the first planar member for attaching to a door frame of a vehicle, and a second pair of tabs mounted along the exterior surface of the second planar member for attaching to a window of a vehicle.

15 Claims, 2 Drawing Sheets

CIGARETTE HOLDER

TECHNICAL FIELD

The present invention relates to devices for holding cigarettes and retaining ashes and more particularly to devices for holding cigarettes and retaining ashes that is connectable between a window and a door frame of a vehicle so that the cigarette smoke exits the vehicle.

BACKGROUND ART

It is well known in the art to have cigarette holders and ash trays which are incorporated into the dashboard and/or the arm rests of a vehicle. However, with these devices the cigarette smoke is maintained in the vehicle permeating the upholstery and the clothing of the occupants. In addition, when non-smokers are in a vehicle smokers often have to refrain from smoking or hang the cigarette out the window.

It would be desirable, therefore, for smokers to have a device for holding a cigarette which directs the smoke out of a vehicle. It would further be desirable, to have a device which may be used on either side of a vehicle. It would further be desirable, to have a device which is removably connectable between a window and door frame of a vehicle.

GENERAL SUMMARY DISCUSSION OF INVENTION

It is thus an object of the invention to provide a cigarette holder that directs cigarette smoke out of a vehicle.

It is a further object of the invention to provide a cigarette holder that may be used on either side of a vehicle.

It is a still further object of the invention to provide a cigarette holder that is removably connectable between a window and a door frame of a vehicle.

Accordingly, a cigarette holder removably connectable between a window and a door frame of a vehicle for directing cigarette smoke out of the vehicle is provided. The cigarette holder comprises: a first and second rigid planar member having an interior and exterior surface, the planar members being connected along a longitudinal edge forming an acute angle, a sidewall connected along a lateral edge of the first and second planar members forming a slot therethrough for snugly entrapping a cigarette, a first pair of tabs mounted along the exterior surface of the first planar member for attaching to a door frame of a vehicle, and a second pair of tabs mounted along the exterior surface of the second planar member for attaching to a window of a vehicle.

The planar members and sidewall are constructed of a rigid heat resistant material such as plastic or metal. The planar members and the sidewall define an ash containing area enclosed on three sides. The slot formed through the sidewall is sized to snugly entrap a cigarette.

The first pair of tabs are mounted along the transverse axis of the exterior surface of the first planar member for connecting the cigarette holder to the door frame of a vehicle. The second pair of tabs are mounted along the transverse axis of the exterior surface of the second planar member for connecting the cigarette holder to a window pane of a vehicle.

In a preferred embodiment of the cigarette holder, the first and second pair of tabs are preferably constructed of a resilient material such as plastic. The first pair of tabs are mounted parallel to one another in a close relationship to form a first pathway therebetween. The first set of tabs may be urged together to be disposed within the window slot of a door frame of a vehicle. With the first pair of tabs disposed within the window slot the tabs tend to spread apart releasably engaging the door frame.

The second pair of tabs are mounted parallel to one another in a close relationship to form a second pathway therebetween. A window pane of a vehicle may be disposed within the second pathway urging the tabs apart releasably gripping the window pane.

In another preferred embodiment, the first and second pair of tabs are constructed of a rigid material such as metal or plastic. Preferably, the first and second pair of tabs are constructed of the same material as the planar members and sidewall.

The first pair of tabs are mounted parallel to one another in a spaced relationship to form a first channel therebetween. A tab may be disposed in the window slot of a door frame releasably engaging a portion of the door frame within the first channel. Preferably, the door frame of a vehicle is disposed within the first channel releasably entrapping the door frame between the first pair of tabs.

The second pair of tabs are mounted parallel to one another in a spaced relationship to form a second channel therebetween. A window pane of a vehicle may be disposed within the second channel slidably entrapping the window pane between the tabs.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
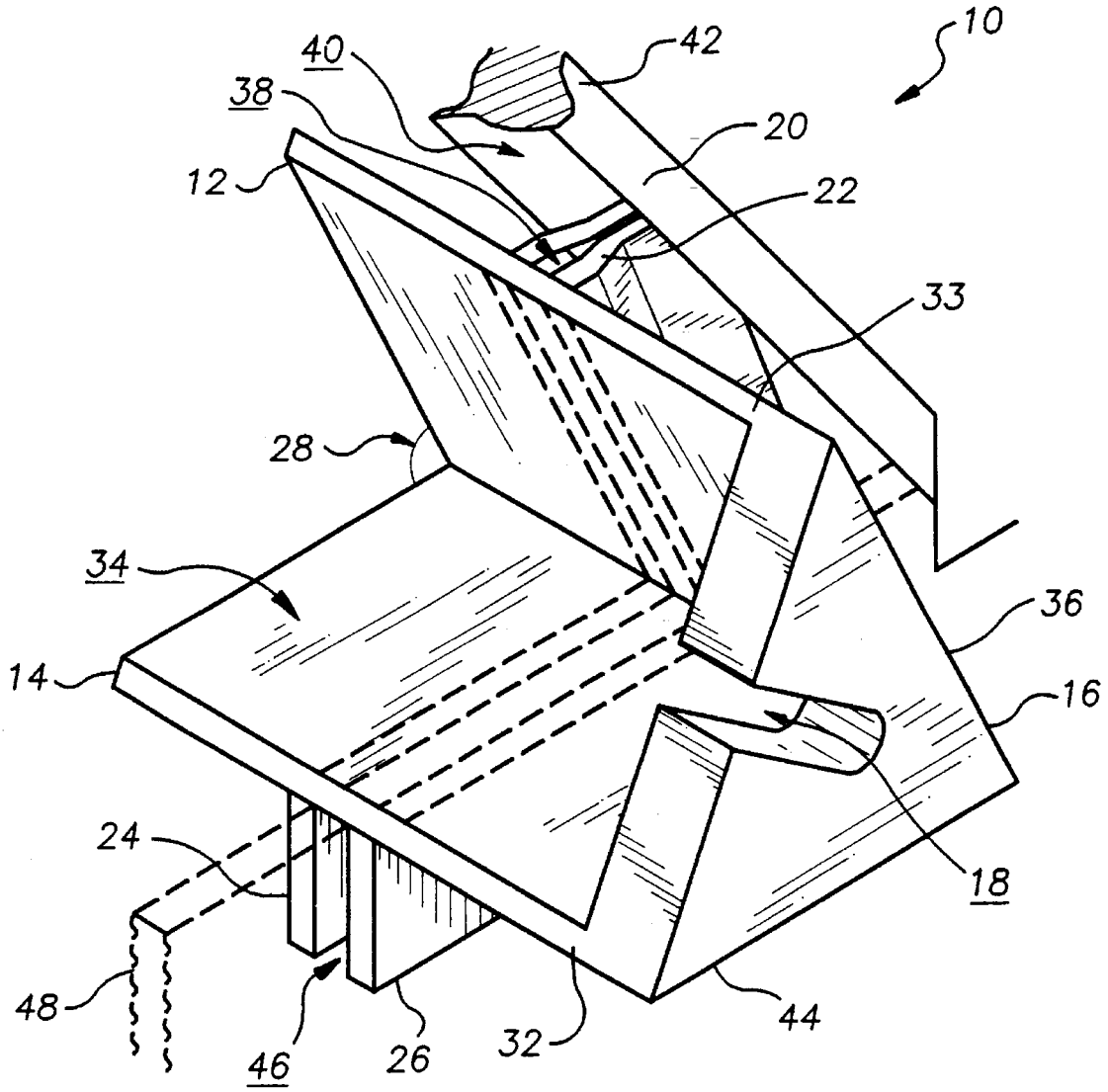
FIG. 1 is an isometric view of an exemplary embodiment of the cigarette holder of the present invention.

FIG. 1 is an isometric view of an exemplary embodiment of the cigarette holder of the present invention generally designated by the numeral 10. Cigarette holder 10 includes a first and second rigid planar member 12,14, a sidewall 16 forming a slot 18 therethrough and a first pair of tabs 20, 22 and a second pair of tabs 24, 26.

First and second planar members 12,14 are made of a hard rigid plastic and are connected along a longitudinal edge to form an acute angle 28. Sidewall 16 is connected along the lateral edges 30, 32 of planar members 12,14 to form an ash container 34. Slot 18 is sized to snugly entrap a cigarette (not shown).

Tabs 20,22 are constructed of a resilient plastic and are mounted along the transverse axis of the exterior surface 36 of first planar member 12. Tabs 20, 22 are mounted parallel to another in a close relationship to define a first pathway 38. As shown in FIG. 1 tabs 20, 22 are urged together and frictionally disposed within window slot 40 of door frame 42 of a vehicle (not shown) releasably engaging door frame 42.

Tabs 24,26 are constructed of resilient plastic and are mounted along the transverse axis of exterior surface 44 of planar member 14. Tabs 24,26 are mounted parallel to another in a close relationship to define a second pathway 46. As shown tabs 24,26.

Figure 2:
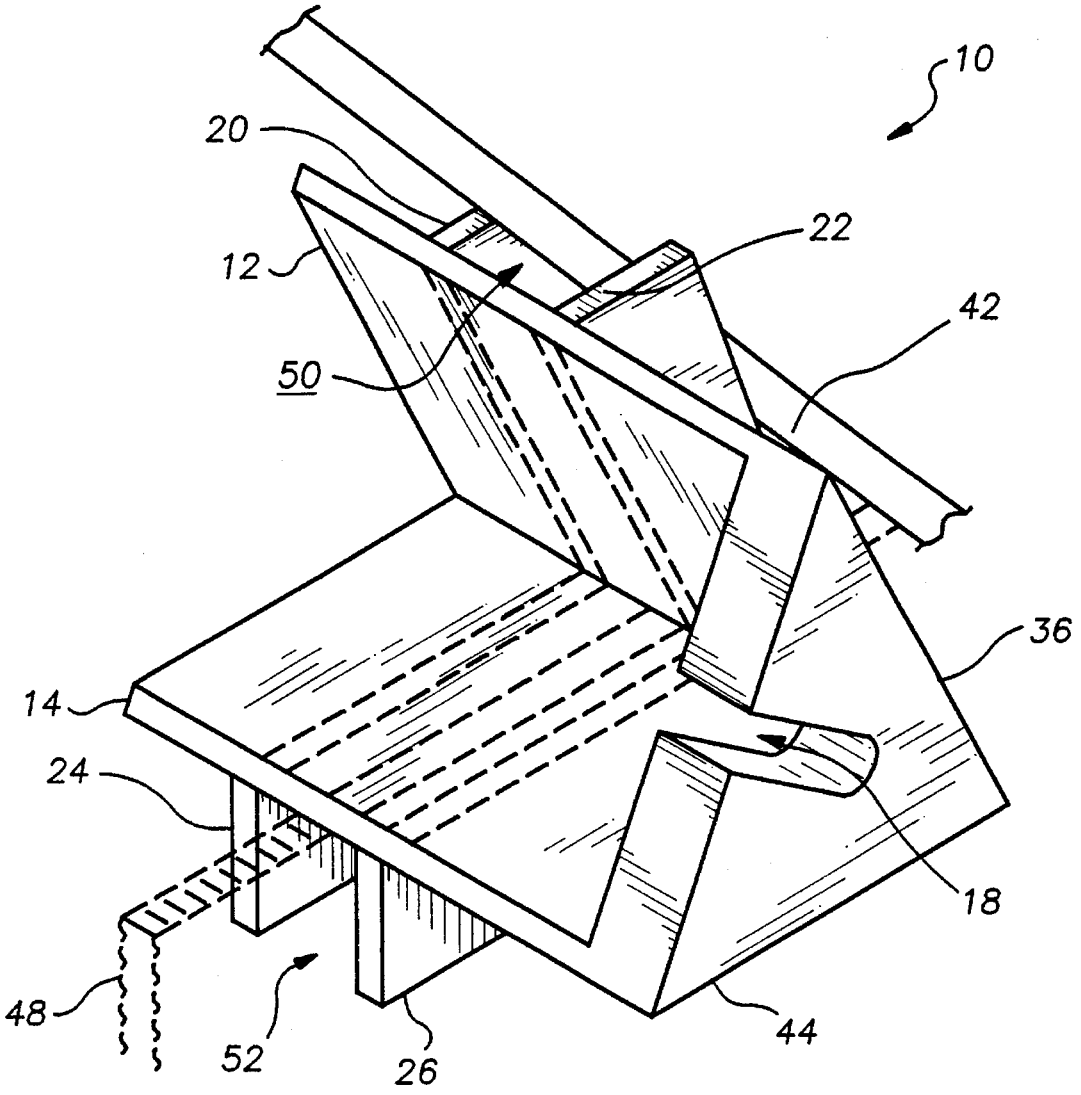
FIG. 2 is an isometric view of another embodiment of the cigarette holder of the present invention.

FIG. 2 is an isometric view of another embodiment of the cigarette holder of the present invention generally designated by the numeral 10. In this embodiment the first pair of tabs 20,22 and the second pair of tabs 24,26 are constructed of a rigid plastic.

Tabs 20 and 22 are mounted along the transverse axis of the exterior surface 36 of first planar member 12. Tabs 20, 22 are mounted parallel to another in a spaced relationship to define a first channel 50. As shown door frame 42 of a vehicle (not shown) is disposed within first channel 50 and is releasably entrapped by tabs 20,22.

Tabs 24 and 26 are mounted along the transverse axis of exterior surface 44 of planar member 14. Tabs 24,26 are mounted parallel to another in a spaced relationship to define a second channel 52. As shown window pane 48 is disposed within second channel 52.

Use of cigarette holder 10 is now described with reference to FIGS. 1 and 2. Cigarette holder 10 is securely entrapped between the window 48 and the door frame 42 of a vehicle (not shown) with sidewall 16 disposed in the interior of the vehicle. A cigarette (not shown) may then be placed in slot 18 so that the smoke is exited from the vehicle.

It can be seen from the preceding description that a device for holding cigarettes and retaining ashes which directs cigarette smoke out of a vehicle, which may be used on either side of a vehicle, and is removably connectable between a window and a door frame of a vehicle has been provided.

It is noted that the embodiment of the cigarette holder described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A cigarette holder removably connectable between a window and a door frame of a vehicle for directing cigarette smoke out of the vehicle, comprising:

a first rigid planar member having an interior and exterior surface;

a second rigid planar member having an interior and exterior surface connected along a longitudinal edge to said first rigid planar member forming an acute angle therebetween;

a sidewall connected between said first and second planar members, said sidewall having a slot therethrough for snugly entrapping a cigarette;

a first pair of tabs mounted along said exterior surface of said first planar member for attaching to the door frame of the vehicle; and a second pair of tabs mounted along said exterior surface of said second planar member for attaching to the window of the vehicle.

2. The cigarette holder of claim 1, wherein:

said first pair of tabs are mounted along the transverse axis of said exterior surface of said first planar member.

3. The cigarette holder of claim 2, wherein:

said first pair of tabs are mounted parallel to one another in a close relationship to form a first pathway therebetween.

4. The cigarette holder of claim 3, wherein:

said second pair of tabs are mounted along the transverse axis of said exterior surface of said second planar member.

5. The cigarette holder of claim 4, wherein:

said second pair of tabs are mounted parallel to one another in a close relationship to form a second pathway therebetween.

6. The cigarette holder of claim 5, wherein:

said first pair of tabs are constructed of a resilient material.

7. The cigarette holder of claim 6, wherein:

said second pair of tabs are constructed of a resilient material.

8. The cigarette holder of claim 7, wherein:

said interior surface of said first and second planar member and said sidewall define an ash containing area.

9. A cigarette holder removably connectable between a window and a door frame of a vehicle for directing cigarette smoke out of the vehicle, comprising:

a first rigid planar member having an interior and exterior surface;

a second rigid planar member having an interior and exterior surface connected along a longitudinal edge to said first rigid planar member forming an acute angle therebetween;

a sidewall connected between said first and second planar members, said sidewall having a slot therethrough for snugly entrapping a cigarette;

said sidewall and interior surface of said first and second planar member defining an ash containing area;

a first pair of resilient tabs mounted parallel to one another in a close relationship along a transverse axis of said exterior surface of said first planar member for attaching to the door frame of the vehicle; and a second pair of resilient tabs mounted parallel to one another in a close relationship along a transverse axis of said exterior surface of said second planar member for attaching to the window of the vehicle.

10. The cigarette holder of claim 1, wherein:

said first pair of tabs are mounted along the transverse axis of said exterior surface of said first planar member; and said first pair of tabs are mounted parallel to one another in a spaced relationship to form a first channel therebetween.

11. The cigarette holder of claim 10, wherein:

said second pair of tabs are mounted along the transverse axis of said exterior surface of said second planar member; and said second pair of tabs are mounted parallel to one another in a spaced relationship to form a second channel therebetween.

12. The cigarette holder of claim 11, wherein:

said first pair of tabs are constructed of a rigid material.

13. The cigarette holder of claim 12, wherein:

said second pair of tabs are constructed of a rigid material.

14. The cigarette holder of claim 13, wherein:

said interior surface of said first and second planar member and said sidewall define an ash containing area.

15. A cigarette holder removably connectable between a window and a door frame of a vehicle for directing cigarette smoke out of the vehicle, comprising:

a first rigid planar member having an interior and exterior surface;

a second rigid planar member having an interior and exterior surface connected along a longitudinal edge to said first rigid planar member forming an acute angle therebetween;

a sidewall connected between said first and second planar members, said sidewall having a slot therethrough for snugly entrapping a cigarette;

said sidewall and interior surface of said first and second planar member defining an ash containing area;

a first pair of rigid tabs mounted parallel to one another in a spaced relationship along a transverse axis of said exterior surface of said first planar member for attaching to the door frame of the vehicle; and a second pair of rigid tabs mounted parallel to one another in a spaced relationship along a transverse axis of said exterior surface of said second planar member for attaching to the window of the vehicle.

* * * * *